US007613077B2

(12) United States Patent
Goeller

(10) Patent No.: US 7,613,077 B2
(45) Date of Patent: Nov. 3, 2009

(54) ALARM CONTROL MECHANISM

(75) Inventor: Eric Goeller, Les Hôpitaux Vieux (FR)

(73) Assignee: Montres Breguet S.A., L'Abbaye (CH)

( * ) Notice: Subject to any disclaimer, the term of this patent is extended or adjusted under 35 U.S.C. 154(b) by 0 days.

(21) Appl. No.: 12/339,202

(22) Filed: Dec. 19, 2008

(65) Prior Publication Data

US 2009/0161497 A1 Jun. 25, 2009

(30) Foreign Application Priority Data

Dec. 20, 2007 (EP) ..... 07150255.3

(51) Int. Cl.
*G04B 23/02* (2006.01)
*G04B 19/00* (2006.01)

(52) U.S. Cl. ..... 368/72; 368/269

(58) Field of Classification Search ..... 368/72–74, 368/243–244, 267–271
See application file for complete search history.

(56) References Cited

U.S. PATENT DOCUMENTS

| | | | | |
|---|---|---|---|---|
| 4,069,658 | A * | 1/1978 | Ito | 368/244 |
| 4,214,134 | A * | 7/1980 | Ogihara et al. | 200/37 R |
| 4,452,537 | A * | 6/1984 | Fukuda et al. | 368/74 |
| 4,922,475 | A * | 5/1990 | Scholer | 368/252 |
| 5,798,986 | A * | 8/1998 | Tzeng | 368/74 |
| 6,018,290 | A * | 1/2000 | Vande Lune et al. | 340/384.1 |
| 7,320,543 | B2 * | 1/2008 | Goeller | 368/100 |
| 2004/0264304 | A1 * | 12/2004 | Furukawa et al. | 368/223 |
| 2007/0147183 | A1 * | 6/2007 | Goeller | 368/269 |
| 2008/0112272 | A1 * | 5/2008 | Goeller | 368/72 |

FOREIGN PATENT DOCUMENTS

| | | |
|---|---|---|
| CH | 341771 | 11/1959 |
| DE | 199 12 320 A1 | 9/1999 |
| GB | 1 397 982 | 6/1975 |

OTHER PUBLICATIONS

European Search Report issued in corresponding application No. EP07150255, completed Aug. 27, 2008.

* cited by examiner

*Primary Examiner*—Vit W Miska
(74) *Attorney, Agent, or Firm*—Griffin & Szipl, P.C.

(57) ABSTRACT

An alarm control mechanism, which is of reduced size widthways and can trigger the striking mechanism with precision. The mechanism includes a group of coaxial wheels (1) including: an hour cam (3), which makes one revolution in 24 hours; a trigger wheel (4) provided with a pinion (6) and an external circular toothing (5), which cooperates with a striking mechanism trigger (30); a programming wheel (7) carrying a cam follower lever (8) and angularly positioned by means (25) for setting the alarm time; a retaining disc, which is called a surprise-piece (11) and is provided with a return spring (12); and a minute cam (14) that makes one revolution per hour. The lever (8) includes a pin (40), which can press against the cams (3, 14) and the surprise-piece (11), and a rack engaged on the pinion (6), such that a radial movement of the lever (8) pivots the trigger wheel (4) in relation to the programming wheel (7). The minute cam (14) includes two notches, for repeating the alarm striking mechanism after an interval of a few minutes.

9 Claims, 5 Drawing Sheets

ALARM CONTROL MECHANISM

This application claims priority from European Patent Application No. 07150255.3 filed Dec. 20, 2007, the entire disclosure of which is incorporated herein by reference.

BACKGROUND OF THE INVENTION

The present invention concerns an alarm control mechanism including a member that triggers a striking mechanism, a rotating hour cam with a radial recess, a cam follower that abuts approximately radially against the hour cam and whose movement can activate the striking mechanism trigger, and manual means for setting the alarm time, arranged for adjusting the relative angular position of the hour cam and the cam follower.

The term "alarm" designates not only the striking system in alarm timepieces, but any device that generates a signal (also called an alarm) at a pre-selected time in any timepiece, particularly a watch.

CH Patent No. 341771 illustrates an example of a mechanism of this type and it includes a rocking lever, one arm of which is pushed by a spring to follow the edge of a rotating spiral-shaped cam with an abrupt radial recess. The cam is friction mounted, so that its angular position can be adjusted to set the alarm time, on a wheel, which is driven by the timepiece movement and completes one revolution in twenty-four hours. The other arm of the lever cooperates with the means triggering the striking mechanism and with a push-button for stopping the striking mechanism. This type of lever occupies a considerable amount of space beside the cam, which can be a drawback, particularly in a large complication watch.

The usual alarm control mechanisms, for example that described in GB Patent No. 1397982, include two coaxial wheels with a frontal cam system between them, so that, at the alarm time, one of the wheels moves axially towards the other and thus triggers the striking mechanism. The main drawbacks of these mechanisms are their relative lack of precision as to the moment the alarm is triggered, and problems to reset the system, so that it strikes again 24 hours later without having to be specially reset by action by the user.

SUMMARY OF THE INVENTION

It is an object of the present invention to create an alarm control mechanism that largely avoids the aforementioned drawbacks of the prior art, while limiting the space occupied by the mechanism, for example so that the mechanism can be integrated in the movement of a grand complication watch. It is a particular object to create a type of mechanism that can, if necessary, be associated with a minute cam, in order to determine more precisely the instant that the striking mechanism is triggered. Moreover, a particular embodiment of the invention should allow the alarm to strike a second time, several minutes after the alarm time.

According to a basic concept of the invention, there is provided a mechanism as defined in claim 1.

Thus, the kinematic chain from the alarm hour cam to the trigger wheel is concentrated in a compact group of coaxial wheels, which can be carried by a common arbour and occupy a reduced space in the plane. Since, in order to set the alarm time, it is the programming wheel and not the hour cam that is acted upon, there is no longer a need for the hour cam to be friction mounted, so that the entire mechanism can be a positive drive mechanism.

Moreover, according to an improved embodiment, this group of coaxial wheels can also include an alarm minute cam. This cam is driven so that it makes one revolution per hour, and it includes at least one radial notch. The cam follower includes a second finger for abutting against the minute cam. Thus, the moment at which the striking mechanism is triggered is determined by the conjunction of the respective positions of the minute cam notch and the hour cam notch. Because of this feature, the moment at which the striking mechanism is triggered can be determined more precisely.

Other characteristics and advantages of the present invention will appear from the following description of a preferred embodiment in connection with the annexed drawings.

DETAILED DESCRIPTION OF ONE EMBODIMENT

Figure 1:
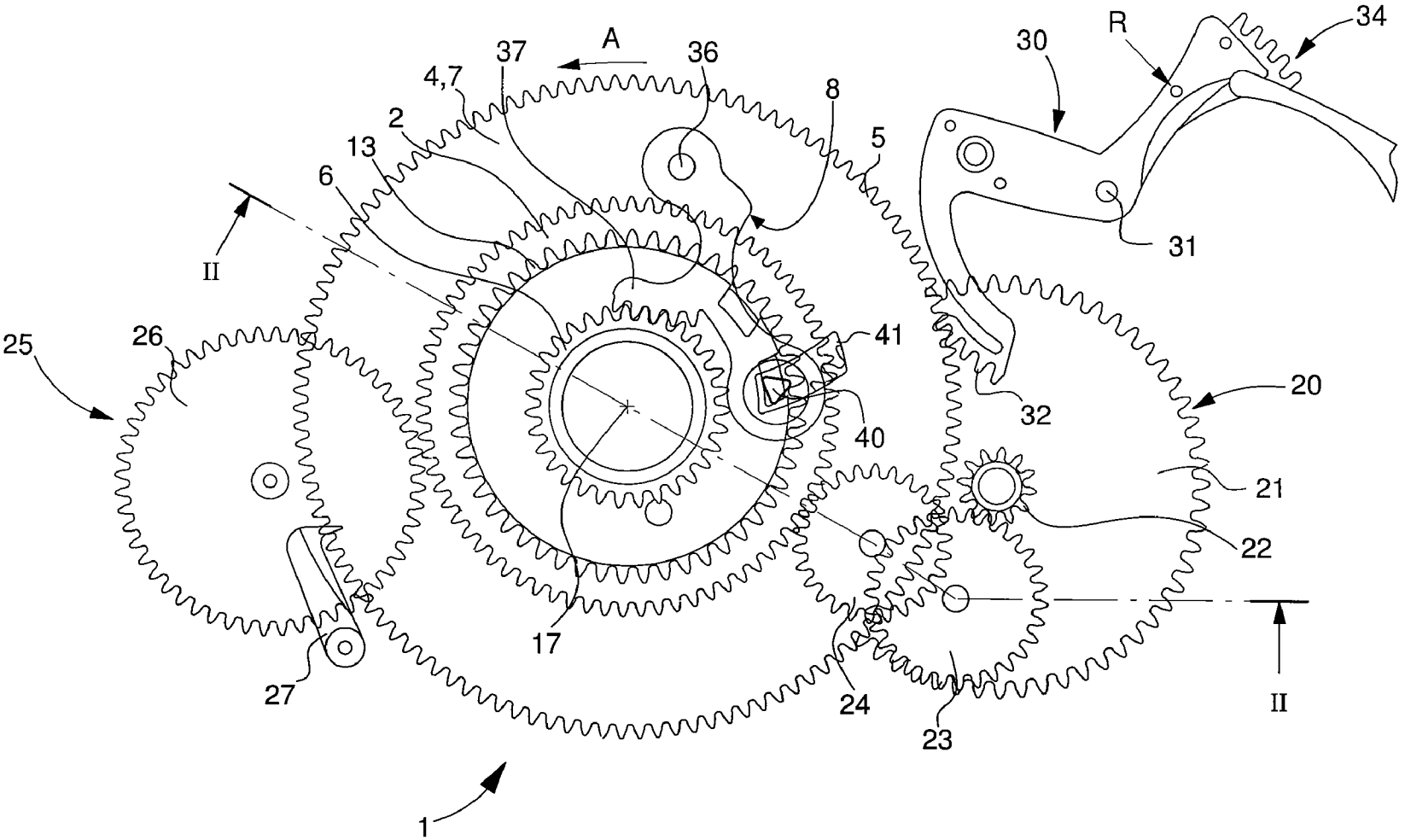
FIG. 1 is a schematic plan view of an alarm control mechanism of the invention, in an alarm watch, with a group of coaxial wheels including, in particular, a trigger wheel, two cams and a programming wheel fitted with a cam follower.
Figure 2:
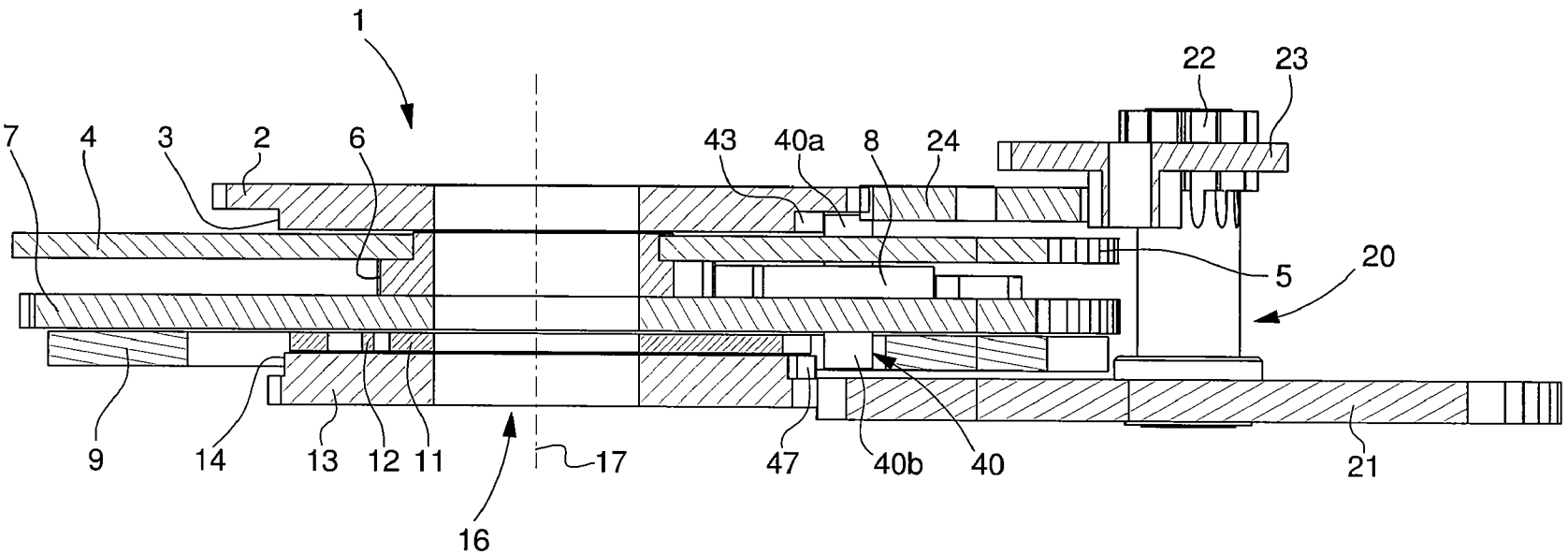
FIG. 2 is a schematic cross-section along the line II-II of FIG. 1.

The alarm control mechanism shown in FIGS. 1 and 2 includes a group 1 of coaxial wheels, including, from top to bottom in FIG. 2: an hour wheel 2, provided with an hour cam 3; a trigger wheel 4 provided, with a circular external toothing 5 and a pinion 6; a programming wheel 7 carrying a cam follower lever 8 and an am/pm cam 9; a retaining disc, called a surprise-piece 11, provided with a spring 12; and finally a minute wheel 13, provided with a minute cam 14. A central bore 16 passes through all of the wheels of group 1, to mount said wheels so that they can rotate freely on an arbour. Each wheel can therefore rotate about a common axis 17, which is perpendicular to the plate (not shown) of the timepiece movement. The hour wheel 2 and minute wheel 13 are connected by a gear train, which has a transmission ratio of 24:1 and includes the minute-wheel and pinion 20 of the analogue current time display of the watch. This minute-wheel and pinion 20 includes a wheel 21 that meshes with wheel 13 and is driven in the usual way by the timepiece movement, such that wheel 13 makes one revolution per hour. Minute-wheel and pinion 20 further includes a pinion 22, connected, by two intermediate wheels 23 and 24, to hour wheel 2, so that the hour wheel continually completes one revolution in 24 hours. Thus, the position of cams 3 and 13 represents the current time displayed by the watch hands, with an additional piece of information (am/pm), since cam 2 determines the time in 24 hours instead of 12 hours.

FIG. 1 shows the elements of group 1 in a transparent manner. In this example, the external toothings of wheels 4 and 7 have practically the same diameter and thus are identical in the plan view. The toothing of programming wheel 4 meshes on a pinion that is not shown, secured to a wheel 26 that forms part of the manual alarm time setting means 25. These means are conventional and do not need to be described here. It will just be pointed out that, in this case, wheel 26 forms part of a minute-wheel and pinion of the analogue alarm time display, including a minute hand, an hour hand that completes one revolution in 12 hours, and an am/pm indicator controlled by a feeler-spindle 27, which abuts against the edge of cam 9, which is secured to the hour wheel 2.

A lever, carried by a pivot 31, forms a striking mechanism trigger 30. A rack 32, located at one end of trigger 30, meshes on toothing 5 of trigger wheel 4. The part of trigger 30 which includes rack 32 is slightly flexible in its plane, which enables the rack to operate like a click on toothing 5, as will be explained below. Trigger 30 is biased in rotation clockwise by a relatively weak return spring (not shown), which is just strong enough to hold rack 32 slightly abutting against toothing 5. Further, when the striking mechanism is in its triggered state, the force of a winding spring R, which acts more powerfully than the return spring, tends to pivot trigger 30 clockwise to hold it pressed strongly against toothing 5 and thus tending to rotate trigger wheel 4 anticlockwise, as indicated by arrow A. The other end of trigger 30 is provided with special members 34 for controlling the working of the striking mechanism, when the trigger pivots clockwise, and the return movement of the trigger when the striking mechanism stops. These members can be of various known types and do not need to be described in detail here.

Figure 3:
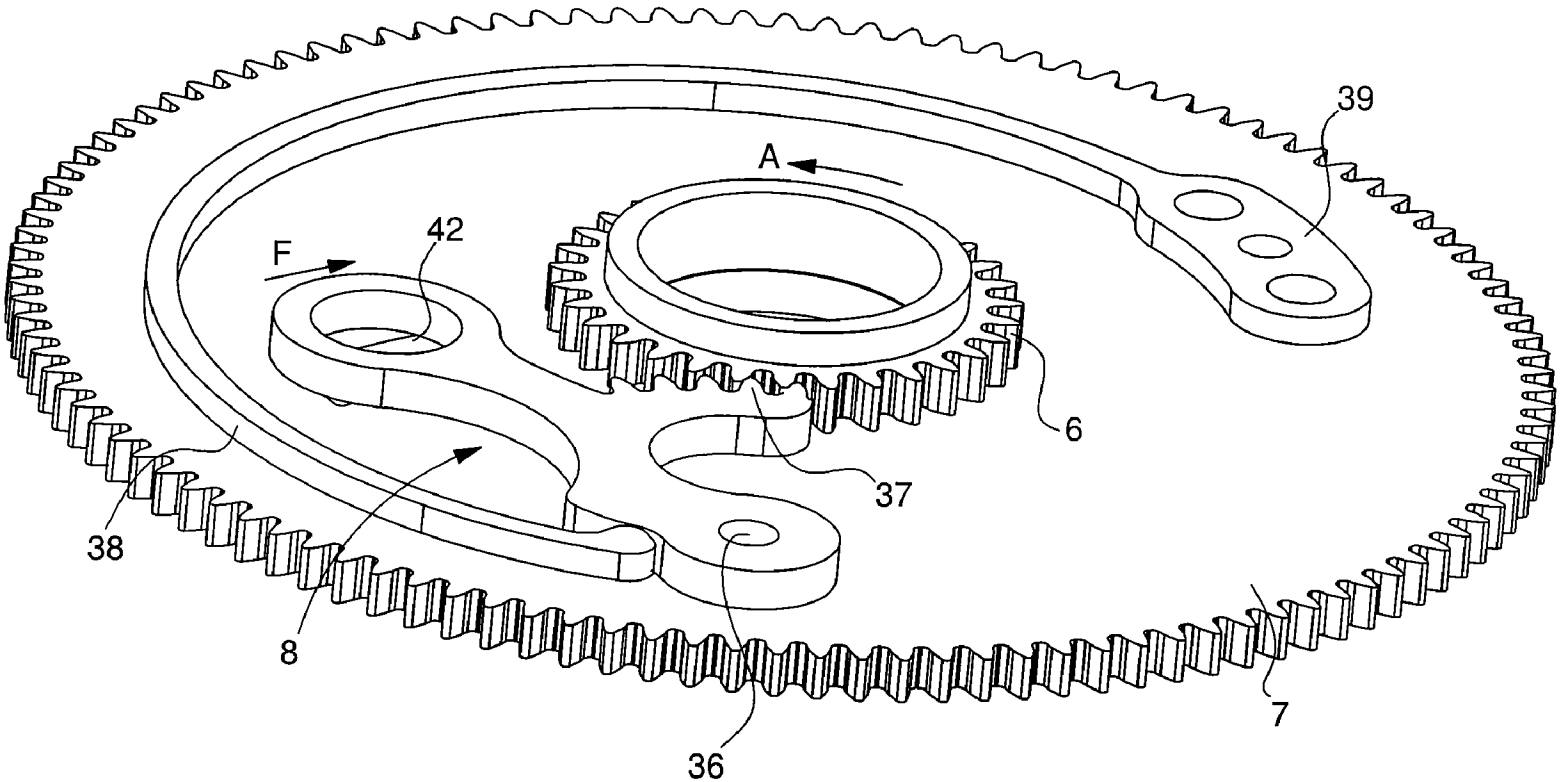
FIG. 3 is a schematic perspective view of the programming wheel.
Figure 4:
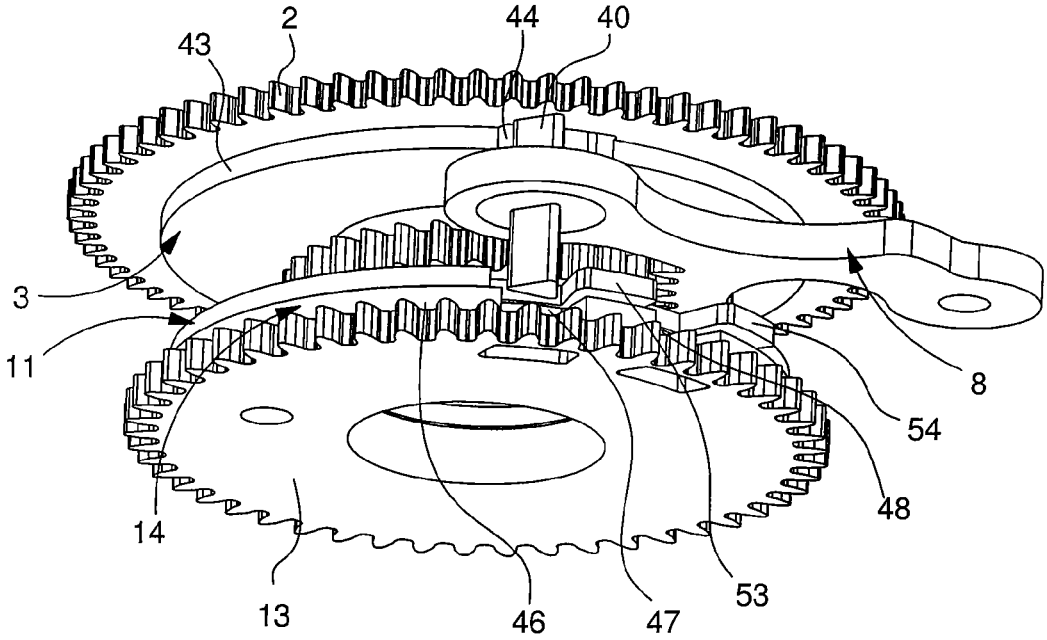
FIGS. 4 and 5 are partial perspective views showing the two cams and the cam follower.
Figure 5:
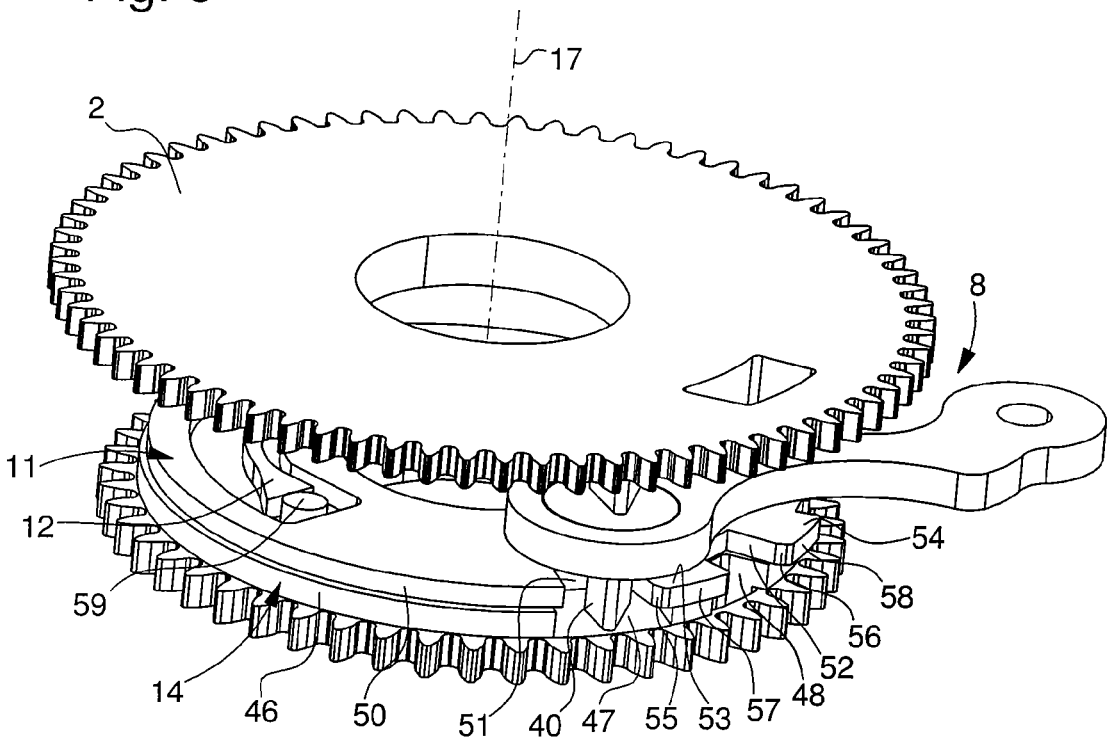

FIGS. 3, 6*a*, 6*b* and 6*c* show details of the cam follower lever 8, mounted on programming wheel 7 by means of a pivot 36, off-centre on wheel 7, lever 8 having a projecting lateral portion provided with a rack 37, meshed on pinion 6 of trigger wheel 5, which has been removed from these Figures in order to make the diagram clearer. To prevent lever 8 from floating, it is pushed inwards slightly by a spring 38 whose rear end 39 is secured to wheel 7, such that lever 8 rests abutting against the toothing of pinion 6. The perspective views of FIGS. 4 and 5 show more particularly how lever 8 cooperates with cams 3 and 14 and surprise-piece 11. A pin 40 of triangular section is secured to the front end of the lever and extends parallel to axis 17. Pin 40 forms a top finger 40*a* and a bottom finger 40*b*, which are able to abut more or less radially against the respective peripheries of cams 3 and 14, and against surprise-piece 11. An aperture 41 (see FIG. 1) is arranged in trigger wheel 4 to allow pin 40 to pass with sufficient play to let it move relative to said wheel. Likewise, FIG. 3 shows that an aperture 42 is arranged in wheel 7 to allow pin 40 (which is omitted in this Figure to clarify the diagram) to pass through said wheel without touching it.

Reference will now be made more particularly to FIGS. 4 and 5. The periphery of hour cam 3 includes a cylindrical portion 43 and a radial notch 44. The periphery of minute cam 14 also includes a cylindrical portion 46, of slightly smaller radius than portion 43 of the other cam, and two radial notches 47 and 48, whose radial inlet recesses are offset from each other by 30°; which is equivalent to 5 minutes rotation of cam 14. The periphery of surprise-piece 11 includes a cylindrical portion 50, of slightly smaller radius than parts 43 and 46 of the cams, and two radial notches 51 and 52, which are shifted angularly to the same extent as notches 47 and 48. However, the radial notches are slightly narrower than notches 47 and 48 in the circumferential direction. Each notch 51, 52 of the surprise-piece is followed by a respectively projecting portion 53, 54, whose external surface includes an inlet bevel 55, 56 followed by a cylindrical portion 57, 58 of slightly larger radius than cylindrical portions 43 and 46 of the cams. One end of spring 12 integrated in surprise-piece 11 abuts against a pin 59, which is secured to the minute cam 14 and tends to hold the surprise-piece in a relative position on the cam, such that projecting portions 53 and 54 of the surprise-piece cover notches 47 and 48. However, when the surprise-piece is stressed anti-clockwise, spring 12 has sufficient radial play to allow surprise-piece 11 to pivot on cam 14 sufficiently to uncover notches 47 and 48 and thus to allow pin 40 to enter one of said notches.

The mechanism operates in the following manner. The user sets the alarm time (with a resolution of the order of one minute) by rotating wheel 26 (see FIG. 1) by means of a suitable command. He thus positions the hour and minute hands of the alarm time display, and programming wheel 7 and trigger wheel 4, linked to wheel 7 via its pinion 6 and cam follower lever 8. The alarm time is set in one direction only, so that wheels 4 and 7 rotate in anticlockwise direction A in FIG. 1, while the time-setting command tips trigger 30 clockwise and thus releases rack 32 from toothing 5 to enable wheel 4 to rotate. Because of the small resistance offered by pinion 6, lever 8 is then raised into the position shown in FIG. 6*b*, where its pin 40 is held away from the cams and surprise-piece 11.

When the alarm striking mechanism is not set, there is no action by winding spring R. Trigger 30 and the cam follower lever 8 are only biased by their weak return springs, so that pin 40 is only gently pushed against the cams and the surprise-piece. Thus pin 40 cannot enter notches 47 and 48, which are covered by projecting portions 53 and 54 of the surprise-piece, since spring 12 offers sufficient resistance to prevent the pin from rotating. Pin 40 slides over the hour cam and passes over the projecting portions of the surprise-piece by sliding over their bevels 55 and 56. Since lever 8 and its pin 40 move very little on wheel 7, wheel 4 and its pinion 6 remain practically stationary and thus do not move trigger 30.

Figure 6A:
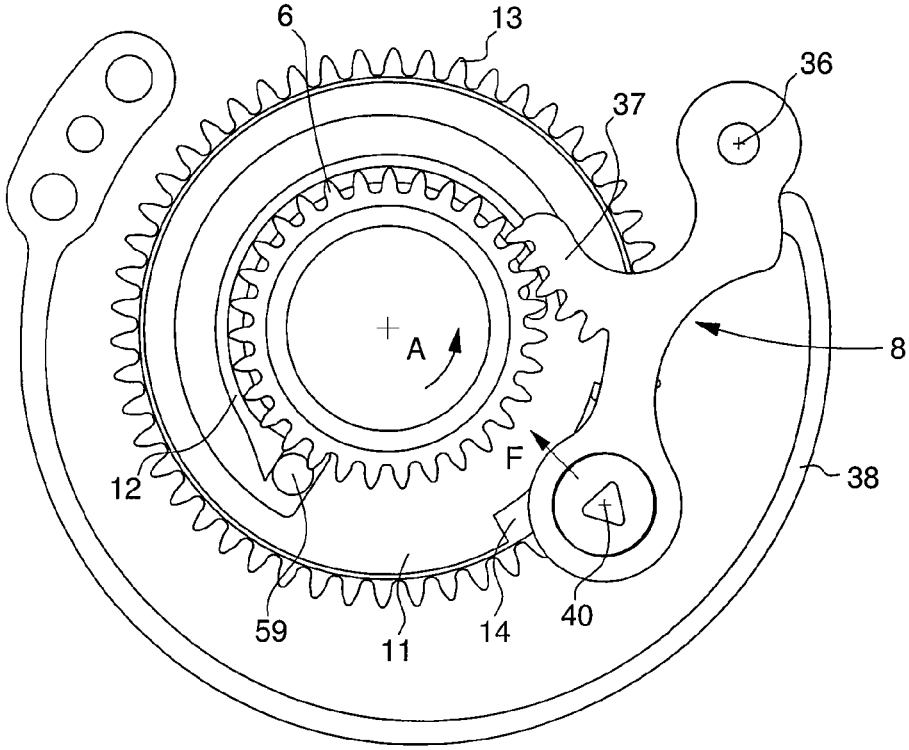
FIG. 6*a* shows the normal position of the cam follower.
Figure 6B:
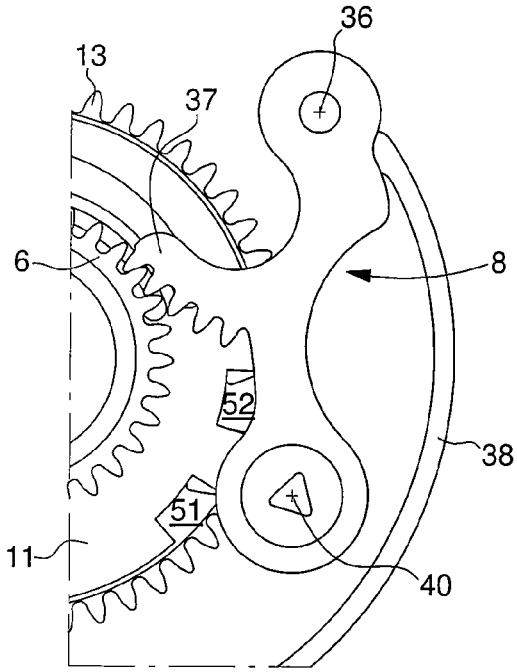
FIGS. 6*b* and 6*c* show two other operating positions of the cam follower.
Figure 6C:
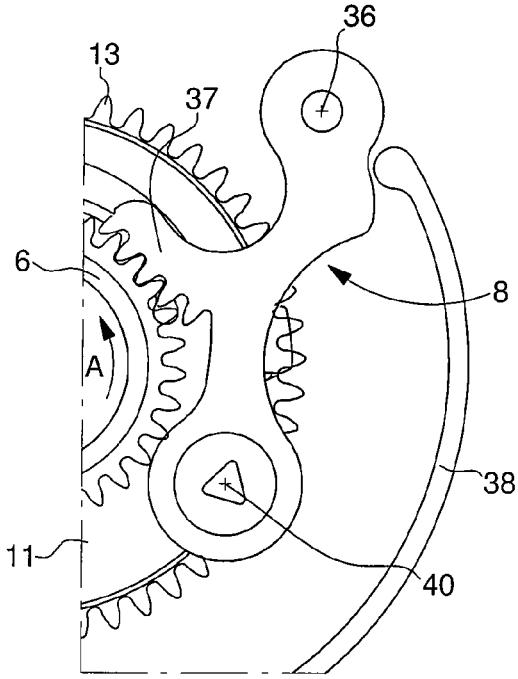

If the alarm striking mechanism is set, this means that spring R acts on trigger 30 and trigger wheel 4 in the direction indicated by arrows R and A (FIG. 1). With reference to FIGS. 3 and 6*a*, pinion 6 then produces a torque on lever 8 tending to press pin 40 radially with some force against the cams and the surprise-piece. Before the alarm time, pin 40 slides against the cylindrical portion 43 of hour cam 3 and cannot therefore fall into the notches of the minute cam when the notches pass in front of the pin.

Several minutes before the alarm time, recess 44 of the hour cam passes in front of pin 40. The pin can then make a slight radial movement to slide against cylindrical part 46 of minute cam 14, as in the situation illustrated in FIG. 5. The pin is then touched via 55 the first projecting portion 53 of the surprise-piece 11, covering the first notch 47 of the minute cam. Force F is sufficient to make pin 40 pivot the surprise-piece in the anticlockwise direction A, overcoming the resistance that spring 12 offers against this movement, until the pin can enter notch 47 at the precise instant chosen as the alarm time. Under the action of spring R, lever 8 makes a limited rocking movement to the position illustrated in FIG. 6*c*. Via rack 37, this movement allows limited pivoting by pinion 6 and trigger wheel 4 in anticlockwise direction A, and trigger 30 in the clockwise direction to a sufficient extent to trigger the alarm striking mechanism. Thus, trigger wheel 4 and its pinion 6 fulfil the function of an intermediate wheel, arranged between lever 8 and striking mechanism trigger 30, for transmitting the rocking movement from the first to the second and vice versa. Because of the circular shape of toothing 5 of wheel 4, this connection is available in any position of programming wheel 7, i.e. for any alarm time setting.

If the user stops the striking mechanism then, this stops the action of winding spring R and the force F of lever 8 on pin 40. Pin 40 is pushed back out of notch 47 by the flank thereof, thus allowing the surprise-piece to return to cover the notch, so that the pin cannot go back in. When the second notch 48 of the minute cam arrives in front of pin 40, bevel 56 of projecting portion 54 of surprise-piece 11 resists sufficiently to push back the pin and allow said pin to pass, by sliding over the surface 58 of the surprise-piece. Thus, the pin cannot enter the second notch 48. Once the second notch and projecting portion 54 have passed, pin 40 can go back to abutting against hour cam 3, whose notch 43 has finished passing.

If the user has not stopped the striking mechanism at the alarm time the striking mechanism stops by itself after a predetermined time, owing to a suitable mechanism, which also acts on the rack of members 34 to pivot trigger 30 anticlockwise, against the force of spring R. Pin 40 can therefore come back out of notch 47 as previously indicated in the preceding paragraph. Next, the aforecited mechanism stops pushing back trigger 30; the effect of spring R is to press the pin against surprise-piece 11 again, then onto minute cam 14. The cylindrical surface of the cam then slides against the pin in the situation illustrated in FIG. 4, until the second projecting portion 54 of the surprise-piece abuts against the pin and is pushed backwards by the pin, causing the surprise-piece to pivot as at the alarm time. Five minutes after the alarm time, the second notch 48 of the minute cam has moved forward enough for pin 40 to be able to enter the second notch and thus allow elements 8, 6, 4 and 30 to pivot to trigger the striking mechanism. The process then continues in the same way as at the alarm time. If desired, the minute cam could have a third radial notch for triggering the striking mechanism a third time.

The construction described above could obviously undergo alterations without losing the essential operating feature, which consists in pivoting the trigger wheel in relation to the programming wheel to trigger the striking mechanism. For example, lever 8 could be replaced by a sliding element. Another variant could consist in replacing the rack transmission 37 and pinion 6 by a permanent system of engaging pin 40 in an oblique slot arranged in trigger wheel 4, such that any radial movement of the pin would cause the wheel to pivot and vice versa.

Moreover, it will be noted that the basic concept of the invention can be applied without reactivating the striking mechanism after a few minutes, and even without using a minute cam, if one is satisfied with less alarm time precision.

What is claimed is:

1. An alarm control mechanism including a striking mechanism trigger, an hour cam, which is driven to make one revolution in 24 hours, and has a radial recess, a cam follower, which abuts approximately radially against the hour cam and the movement of which is capable of activating the striking mechanism trigger, and manual means for setting the alarm time, arranged to adjust the relative angular position of the hour cam and the cam follower, wherein it includes a programming wheel and a trigger wheel, which both have the same rotational axis as the hour cam, the programming wheel being connected to the alarm time setting means, the trigger wheel having a circular toothing, which cooperates with the striking mechanism trigger, and wherein the cam follower is mounted so as to move on the programming wheel and is connected to the trigger wheel, so as to pivot said trigger wheel relatively to the programming wheel when said cam follower moves.

2. The mechanism according to claim 1, wherein the cam follower is mounted on a pivot, which is off-centre on the programming wheel.

3. The mechanism according to claim 2, wherein the cam follower is formed by a lever that has a first finger, which abuts against the hour cam.

4. The mechanism according to claim 3, wherein the cam follower is provided with a rack, which is meshed with a pinion of the trigger wheel.

5. The mechanism according to claim 1, wherein the striking mechanism trigger, arranged for pivoting back and forth, includes a toothed sector, which cooperates with said toothing of the trigger wheel, so as to follow the rotation of said wheel in a first direction, whereas during rotation in the opposite direction, the toothed sector makes a return movement and then operates like a click if the trigger wheel makes an additional rotation, particularly when the alarm time is being set.

6. The mechanism according to claim 5, wherein when the striking mechanism is set, the striking mechanism trigger is biased by a spring R that tends to make the trigger drive the trigger wheel in said first direction such that the trigger wheel tends to press the cam follower against the hour cam.

7. The mechanism according to claim 3, wherein it includes a minute cam, driven so as to make one revolution per hour about the same rotational axis as the hour cam and including at least one radial notch, and wherein the cam follower includes a second finger, which is capable of abutting against the minute cam.

8. The mechanism according to claim 7, wherein the hour and minute cams are connected by gears, which include minute-wheel and pinion that forms part of an analogue display of the current time.

9. The mechanism according to claim 7, wherein the minute cam includes at least two successive radial notches and is associated with a retaining disc called a surprise-piece, which can pivot about said rotational axis against a return spring and having at least two projecting portions, which cover said radial notches when the surprise-piece is in the rest position.

* * * * *